US005274391A

United States Patent [19]

Connolly

[11] Patent Number: 5,274,391

[45] Date of Patent: Dec. 28, 1993

[54] BROADBAND DIRECTIONAL ANTENNA HAVING BINARY FEED NETWORK WITH MICROSTRIP TRANSMISSION LINE

[75] Inventor: Kevin J. Connolly, Freehold, N.J.

[73] Assignee: Radio Frequency Systems, Inc., Marlboro, N.J.

[21] Appl. No.: 603,123

[22] Filed: Oct. 25, 1990

[51] Int. Cl.[5] ..... H01Q 9/16

[52] U.S. Cl. ..... 343/820; 343/821; 343/812; 343/789; 343/814

[58] Field of Search ..... 343/820, 810, 812, 813, 343/814, 816, 821, 872, 893, 822, 789

[56] References Cited

U.S. PATENT DOCUMENTS

| | | | |
|---|---|---|---|
| 2,130,033 | 9/1938 | Schariau | 343/813 |
| 2,455,403 | 12/1948 | Brown | 343/816 |
| 3,482,253 | 12/1969 | Zucconi | 343/872 |
| 3,496,570 | 2/1970 | Lewis | 343/813 |
| 3,681,771 | 8/1972 | Lewis et al. | 343/821 |
| 3,747,114 | 7/1973 | Shyhalla | 343/821 |
| 3,750,185 | 7/1973 | Evans | 343/821 |
| 4,031,537 | 6/1977 | Alford | 343/872 |
| 4,518,969 | 5/1985 | Bogner | 343/821 |
| 4,929,961 | 5/1990 | Nakase | 343/715 |

FOREIGN PATENT DOCUMENTS

| | | | |
|---|---|---|---|
| 1236535 | 6/1960 | France | 343/810 |

*Primary Examiner*—Donald T. Hajec
*Assistant Examiner*—Hoanganh Le

[57] ABSTRACT

A broadband antenna array, formed of pairs of horizontally-spaced dipoles that are balun-fed, uses an air dielectric microstrip binary-feed network to optimize antenna bandwidth. Each dipole is fed by a three-wire balun which maintains the proper current distribution on the dipoles over the operating bandwidth. The binary-feed network feeds each dipole individually to further optimize the antenna's pattern bandwidth. The binary-feed network is formed using a conductive ground plane with spaced conductors to utilize an air dielectric, thereby minimizing antenna losses in the feed network. The feed network impedances are chosen to give a broadband impedance match to the dipoles, and the entire assembly of binary-feed network and dipoles is mounted in a reflector box, the dimensions of which are chosen to control the antenna beamwidth. Vertically stacked pairs are used to compress the vertical radiation pattern for greater antenna gain.

15 Claims, 8 Drawing Sheets

FIG. 4
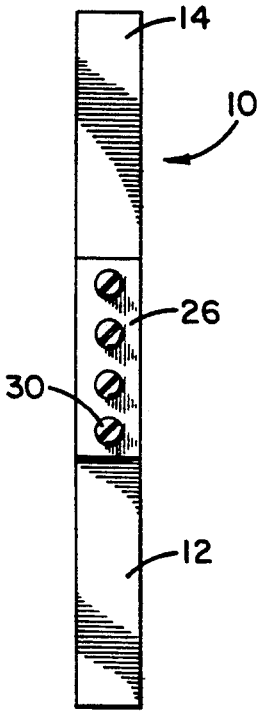
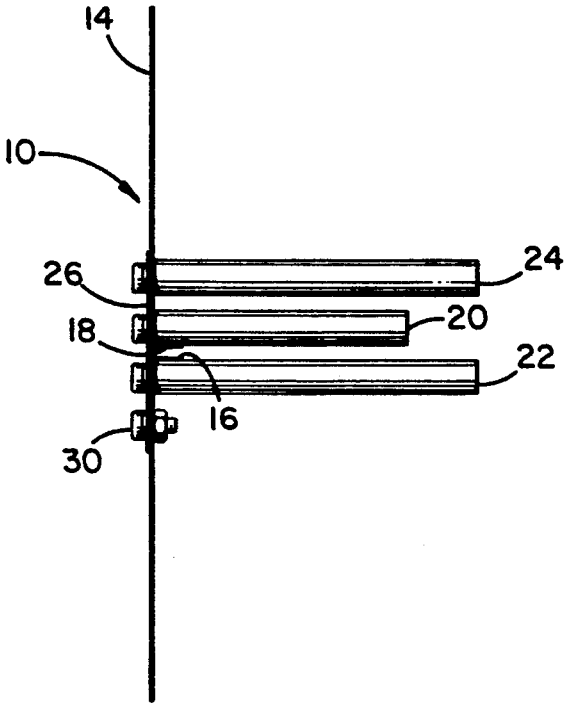
FIG. 3

BROADBAND DIRECTIONAL ANTENNA HAVING BINARY FEED NETWORK WITH MICROSTRIP TRANSMISSION LINE

FIELD OF THE INVENTION

The present invention relates to antennas, and more particularly to a broadband directional panel antenna having a radiation pattern with a high front-to-back ratio.

DESCRIPTION OF THE PRIOR ART

In the antenna field, there has been a need for a broadband directional antenna exhibiting a relatively high gain and a high front-to-back radiation ratio. Particularly in the field of cellular telephone communications, there is a need for a vertically-polarized directional antenna to fill gaps in the radiation patterns of the cells.

A typical method of providing a directional antenna is to use an omnidirectional antenna mounted in front of a reflector to shape the horizontal pattern. Such an omnidirectional antenna can be center fed at a single feed point, or fed at multiple feed points with a feed network. There are pattern bandwidth limitations with a single feed point (70 MHz maximum bandwidth @ 860 MHz for an 8dBd omnidirectional and 40 MHz maximum bandwidth @ 860 MHz for a 10dBd omnidirectional).

The omnidirectional antenna is usually enclosed in a dielectric tube for protection, and the tube usually has an outer diameter of between 1 ½–3 inches, which severely restricts the mechanical size and complexity of the feed networks that may be used. A broadband binary-feed network is possible, but small-diameter lossy coaxial cable must be used, and as a result the antenna efficiency is greatly reduced because of losses. If air line coaxial cable is used, the number of feed points is limited due to the size of the feed lines required.

The omnidirectional antenna is usually formed by a plurality of colinear dipoles; however, a problem experienced with multi-feed colinear arrays is that low RF isolation is provided between adjacent dipoles. This can affect the vertical pattern and reduce gain over the bandwidth of the antenna. Thus, utilizing a vertical array of colinear dipoles can become quite complex and operates well over a limited frequency band.

Another solution for providing a directional antenna is to utilize individual dipoles stacked vertically and mounted to a reflector, the dipoles being fed with a coaxial transmission line feed network. The limitations experienced in this type of antenna usually result from the use of coaxial cable for feeding the array and the elements. There are usually significant energy losses in the cable due to the dielectric insulator used, and the small inner conductor. In addition, it can be difficult to maintain a broad impedance match due to differences in the standard impedances in off-the-shelf cables, thereby making it difficult to optimize the impedance over a broad bandwidth.

SUMMARY OF THE INVENTION

The present invention provides for an extremely low-cost and simple broadband directional panel antenna configuration which is vertically-polarized, exhibits a high-gain, and avoids the aforementioned problems of the prior art.

The antenna structure of the present invention is in the form of a broadband array of balun-fed dipoles. The array of dipoles is uniquely fed by an air dielectric microstrip binary-feed network. By using dipoles fed by a three-wire balun and a binary feed, the proper current distribution on the dipoles over the entire operating bandwidth is maintained. Each dipole is individually fed by the binary-feed network in a manner which optimizes pattern bandwidth. There are negligible losses in the feed system, due to the air dielectric insulator and a large inner conductor which minimizes antenna loss, thereby increasing the antenna efficiency. The feed network and the dipole antenna utilize impedance matching techniques to provide the most broadband impedance match possible.

The antenna array is formed of vertically-mounted colinear layers, each layer consisting of two horizontally-spaced dipoles fed by an air dielectric microstrip binary-feed network. The antenna array is uniquely disposed in a reflector box which functions as the reflector for the array, a ground plane for the feed network, and part of a weather protection housing. By controlling the dimensions of the box and the dipole spacing, the horizontal beamwidth can be accurately controlled. By using a plurality of layers of horizontally-spaced dipoles, the radiation pattern has a vertically-compressed beam which significantly enhances the antenna gain. Thus, vertical compression may be controlled by the number of vertically stacked layers that are used.

A primary objective of the present invention is to provide a broadband directional antenna having a radiation pattern with a very high front-to-back ratio.

Another objective of the present invention is to provide an antenna design wherein an array of dipoles is mounted in a box which acts as a reflector for the array, the ground plane for a feed network and as part of the weather protection housing.

Another objective of the present invention is to provide an antenna structure that is inexpensive, simple and easy to manufacture without the need for expensive components.

Another objective of the present invention is to provide an antenna structure utilizing a simple feed line network which provides for impedance matching and low signal loss.

The aforementioned objectives and advantages of the invention will be further described with particularity in the following more detailed description of the invention, taken in conjunction with the accompanying drawings.

DESCRIPTION OF THE DRAWINGS

FIG. 3 is a side view of a dipole with a three-wire balun feed as used in the present invention.

FIG. 4 is a front view of the dipole of FIG. 3.

DETAILED DESCRIPTION OF THE PREFERRED EMBODIMENT

Figure 1:
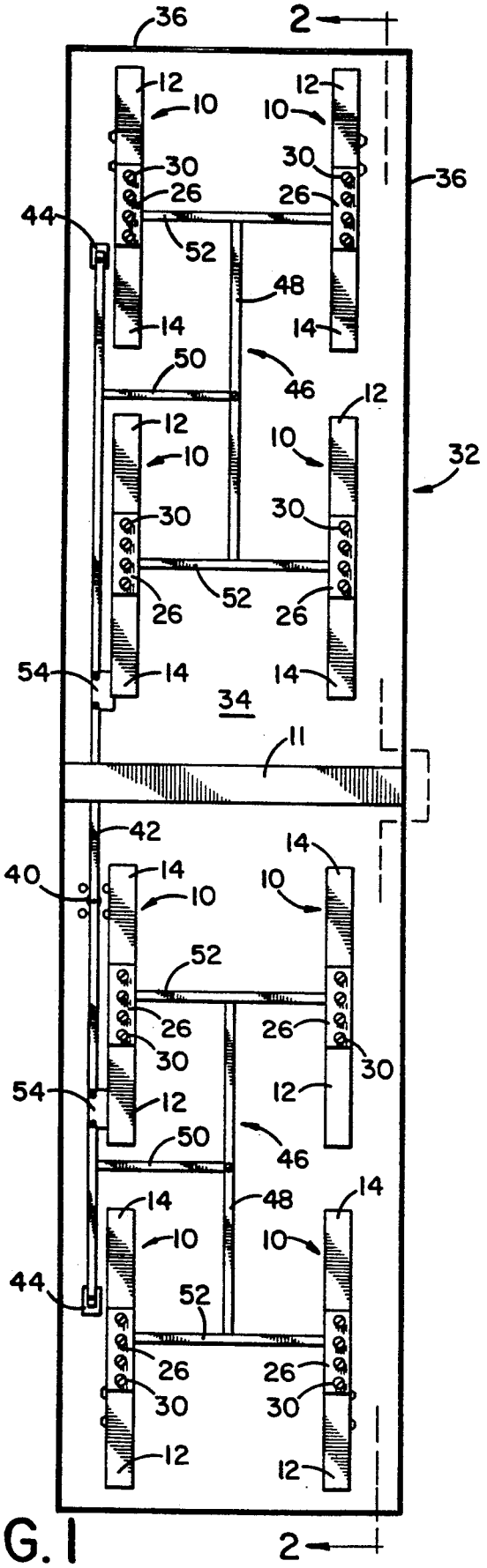
FIG. 1 is a front view of an antenna array constructed in accordance with the teachings of the present invention.
Figure 2:
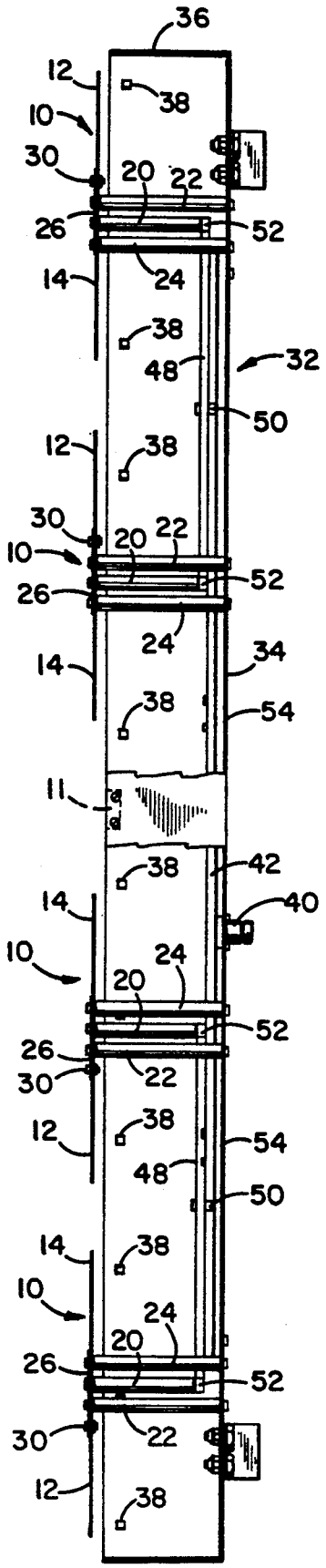
FIG. 2 is a vertical section taken along line 2–2 of FIG. 1.

Referring to FIGS. 1 and 2, there is shown a front view and a vertical section of the proposed antenna structure comprising eight vertical dipoles 10 arranged in an array of four layers, with each layer consisting of two horizontally-spaced dipoles. The horizontal spacing between the dipoles is approximately $\frac{1}{2}\lambda$, where $\lambda$ is the wavelength of the center frequency of the antenna. The frequency range of the antenna is 806–960 MHz. The center frequency of this range has a wavelength of 13.42 inches. The actual horizontal spacing of the antenna shown in FIG. 1 is $0.46\lambda$. The corresponding dipoles of each layer are colinearly positioned along common axes spaced approximately $\frac{1}{2}\lambda$ apart. The vertical spacing between the centers of the dipoles of adjacent layers is approximately $\frac{1}{4}\lambda$. In the embodiment of FIG. 1, the spacing between the first and second and third and fourth layers is $0.72\lambda$, while the spacing between the second and third layers is $0.88\lambda$ to accommodate a support bracket 11. The spacing between the centers of the dipoles of adjacent layers is approximately $1.0\lambda$.

It has been determined that the utilization of two horizontally-spaced dipoles provides an improved and adjustable horizontal radiation pattern and beamwidth dependent upon the horizontal spacing. Any number of layers of dipoles may be stacked, depending upon the degree of vertical beam compression that is desired to increase the gain of the antenna. The use of four layers, as shown in FIG. 1, is merely for illustrative purposes, and it is to be understood that additional or fewer layers could be utilized, depending upon the particular application. Embodiments with 1, 2, 4 and 8 layers have been constructed and tested.

Although any one of several structures for the vertical dipoles may be utilized to practice the invention, the illustrated embodiment shows the dipoles are formed of opposing arms 12 and 14, each formed primarily of a vertical portion and smaller horizontal portion 16 and 18, as shown more clearly in FIG. 3. Horizontal portions 16 and 18 are spaced apart by a predetermined distance, such as $\frac{3}{8}$ inch, and function to provide capacitive loading for impedance matching purposes. As previously mentioned, the arms 12 and 14 of all the dipoles on a side of each layer are colinearly aligned along a common axis. The total length from tip to tip of the two dipole arms may vary between $0.2\lambda$ and $\lambda$, but are approximately $\frac{1}{2}\lambda$ in length. In the embodiment shown, the total length is $0.6\lambda$.

Referring specifically to FIG. 2, it is shown that the dipoles are center-fed, using a classic type, three-wire, of balun to provide the necessary transformer action from an unbalanced to a balanced condition. The center feed mechanism is provided using three parallel cylindrical members 20, 22 and 24. The cylinders are constructed of standard $\frac{3}{8}$ inch diameter aluminum rod, with the center cylindrical post 20 providing the center feed for the dipole and the outer cylindrical posts 22 and 24 connecting the arms of the dipole to a ground plane. Posts 22 and 24 are $0.26\lambda$ long, while post 20 is $0.22\lambda$ long. A space of 3/16 inch is provided between the outer cylindrical posts 22 and 24 and the inner post 20. While the spacing between these posts may vary from antenna design to antenna design, as may the $\frac{3}{8}$ inch spacing between the arm portions 16 and 18, it is extremely important that these spaces be identical for all dipoles in the array, so that a balanced feed is achieved.

The cylindrical posts 20, 22 and 24 are each fixed at one end; but to provide additional support and to maintain the spacing between portions 16 and 18, a fiberglass strip 26 is mounted across the tops of the posts. Strip 26 is in juxtaposition with the arms 12 and 14 and spans the space between the portions 16 and 18. In each dipole arms 12 and 14 and the fiberglass strip 26 are mounted to the cylindrical posts using three mounting screws. A fourth mounting screw 30 is used to connect the fiberglass strip 26 to arm 12 to prevent inadvertent rotation of arm 12 about post 22. It should be noted that post 24 connects arm 14 with a ground plane and thus creates an electrical $\frac{1}{4}\lambda$ short which will appear as an open in the transmission line. Thus, all of the dipoles 10 are balun-fed to provide the necessary balance transformation between the feedline and the antenna.

The array of dipoles 10 is mounted in a reflector box 32, preferably formed of aluminum sheet material. The box functions as a reflector for the dipole array to provide the necessary directionality and to develop the desired horizontal beamwidth in conjunction with the horizontally-spaced dipole pairs. The reflector box 32 includes a bottom 34 and side walls 36. The reflecting function of box 32 is performed primarily by the bottom 34, but the directionality is also contributed to by the side walls 36. In the embodiment shown, the box has a width of $0.73\lambda$ and a depth of $0.25\lambda$, which in conjunction with a dipole spacing of $0.46\lambda$ generates a horizontal beamwidth of 62°.

The bottom 34 of box 32 satisfies an additional function, in that it provides the ground plane for a microstrip binary-feed network. It is to be noted that the cylindrical posts 22 and 24 are mounted to bottom 34, thereby connecting the dipole to the ground plane.

Figure 7:
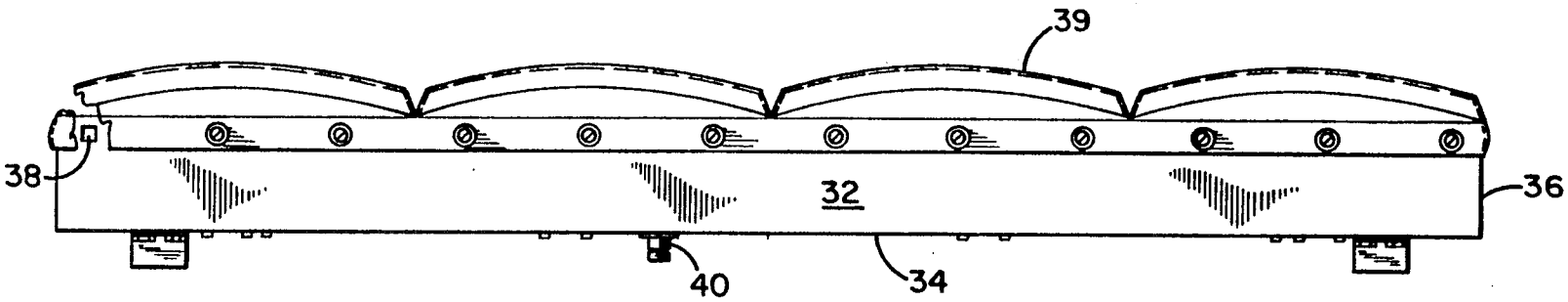
FIG. 7 is a side view of the antenna structure of the present invention.

The sides 36 of reflector box 32 have a plurality of openings 38 for mounting a plastic or fiberglass radome 39 over the front of the antenna array as shown in FIG. 7. Thus, the reflector box 32 uniquely performs three functions, namely a reflector for the array, a ground plane for the feed network, and a weather protection housing for the antenna array.

Figure 5:
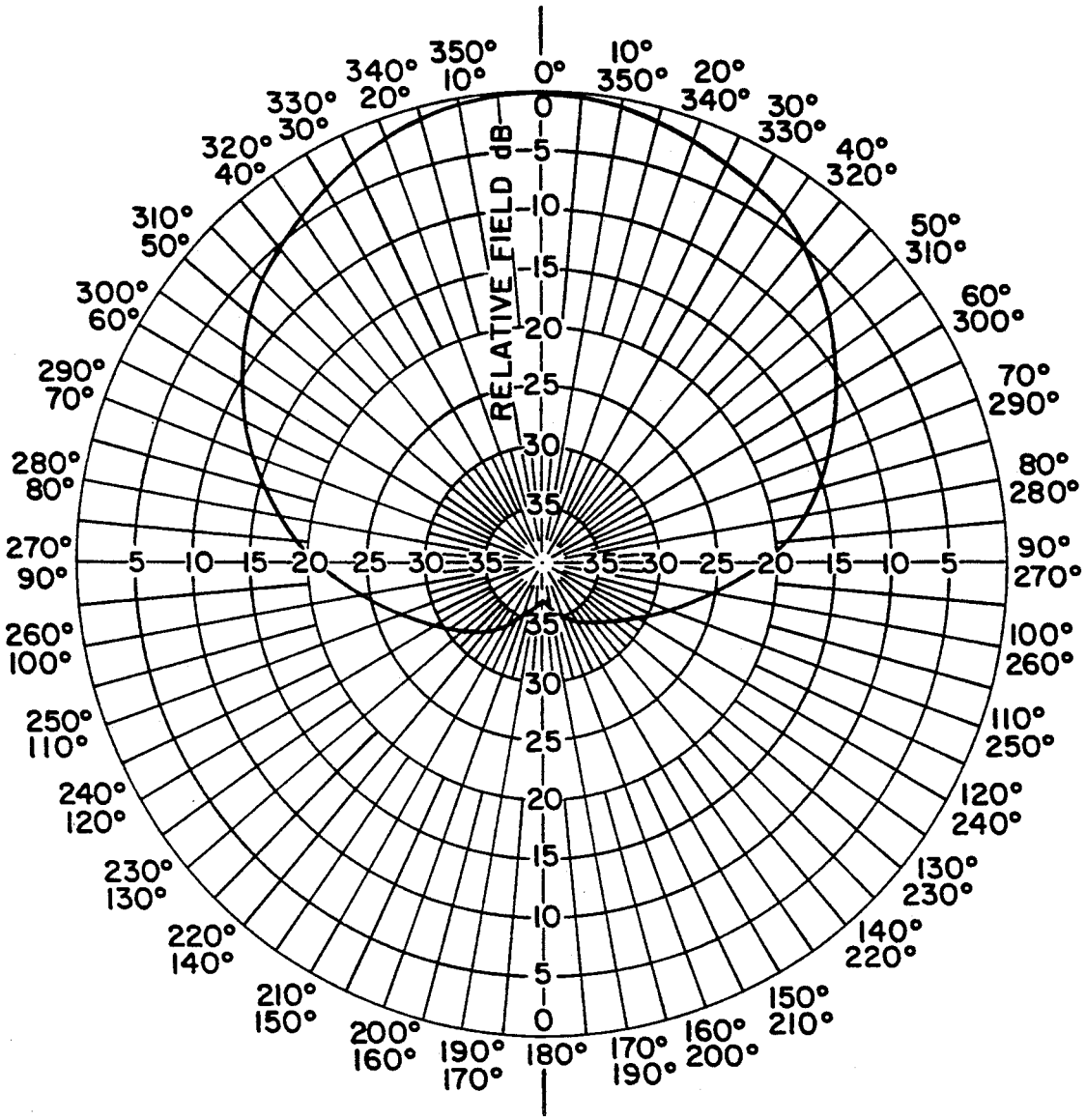
FIG. 5 is a graph showing the horizontal radiation pattern of the antenna shown in FIGS. 1 and 2.

The use of two horizontally-spaced dipoles in conjunction with the reflector box provides the required horizontal beamwidth and a high front-to-back ratio by significantly suppressing the signal radiation behind the antenna, as illustrated in FIG. 5, which shows an H-Plane pattern for the antenna, which pattern clearly illustrates the nearly negligible backwards radiation. In FIG. 5, 0° is the forward direction and 180° the backward direction.

Figure 6A:
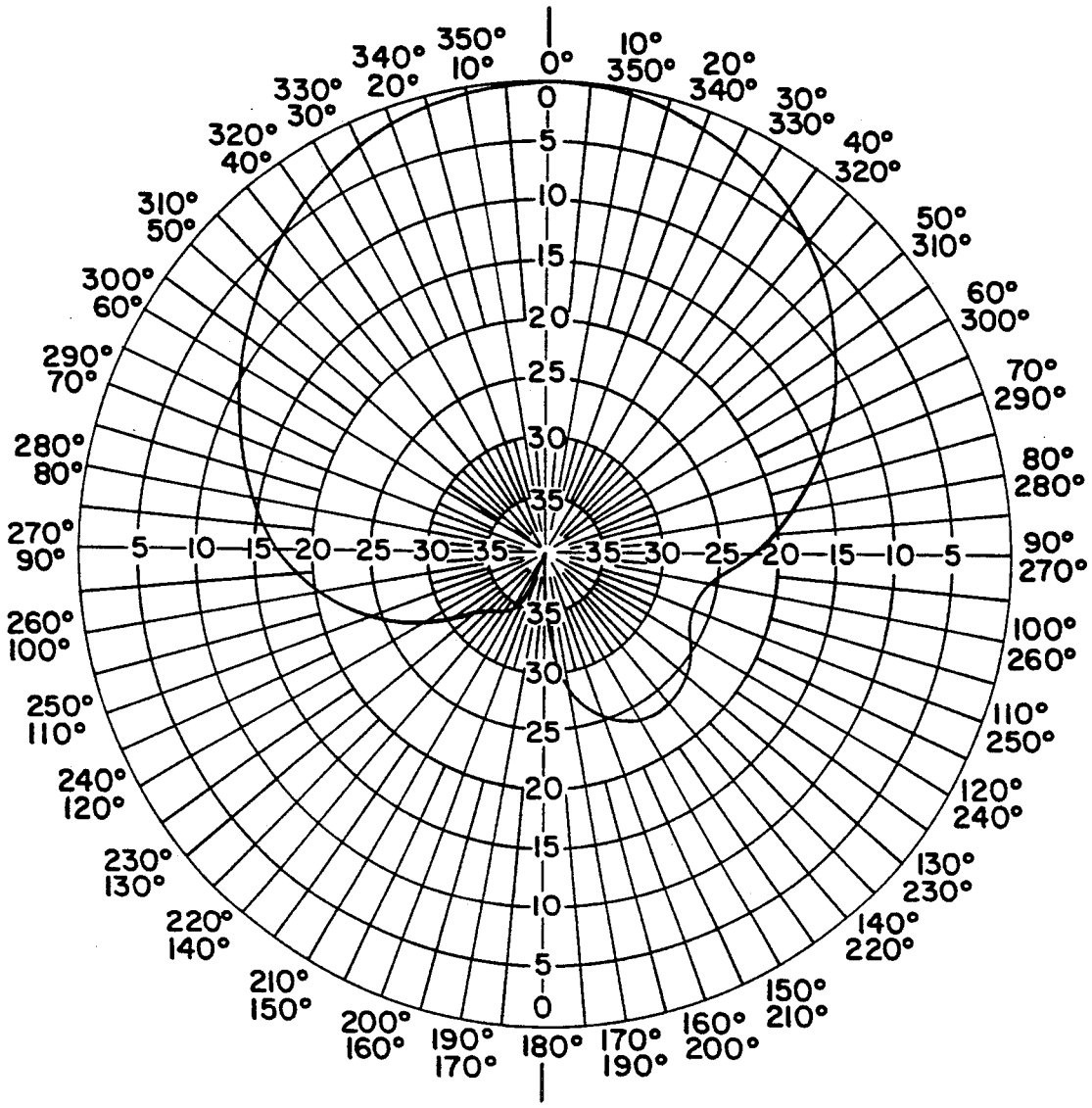
FIGS. 6A–6D are graphs showing the vertical radiation patterns of antennas constructed in accordance with the teachings of the present invention.
Figure 6B:
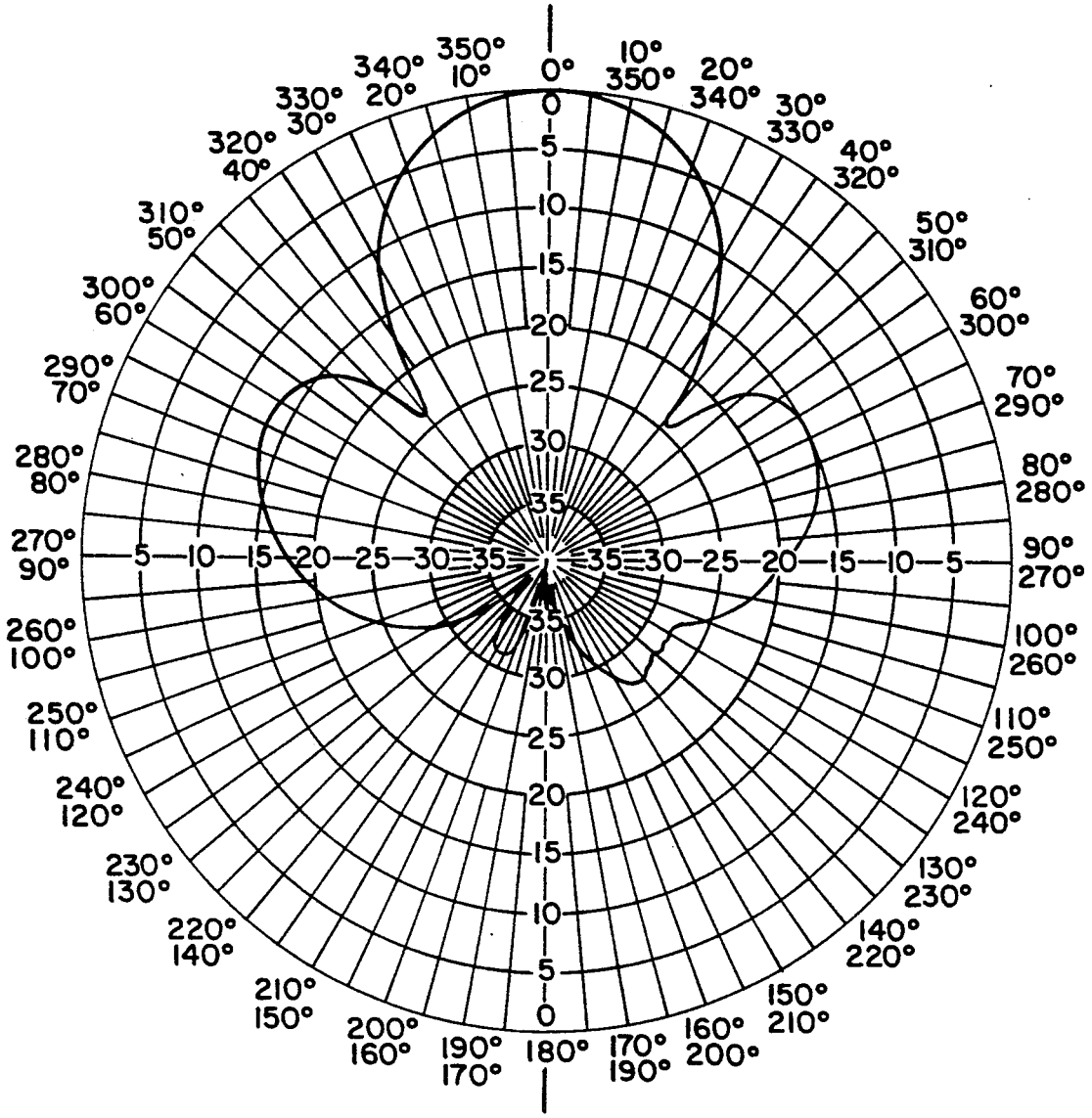
Figure 6C:
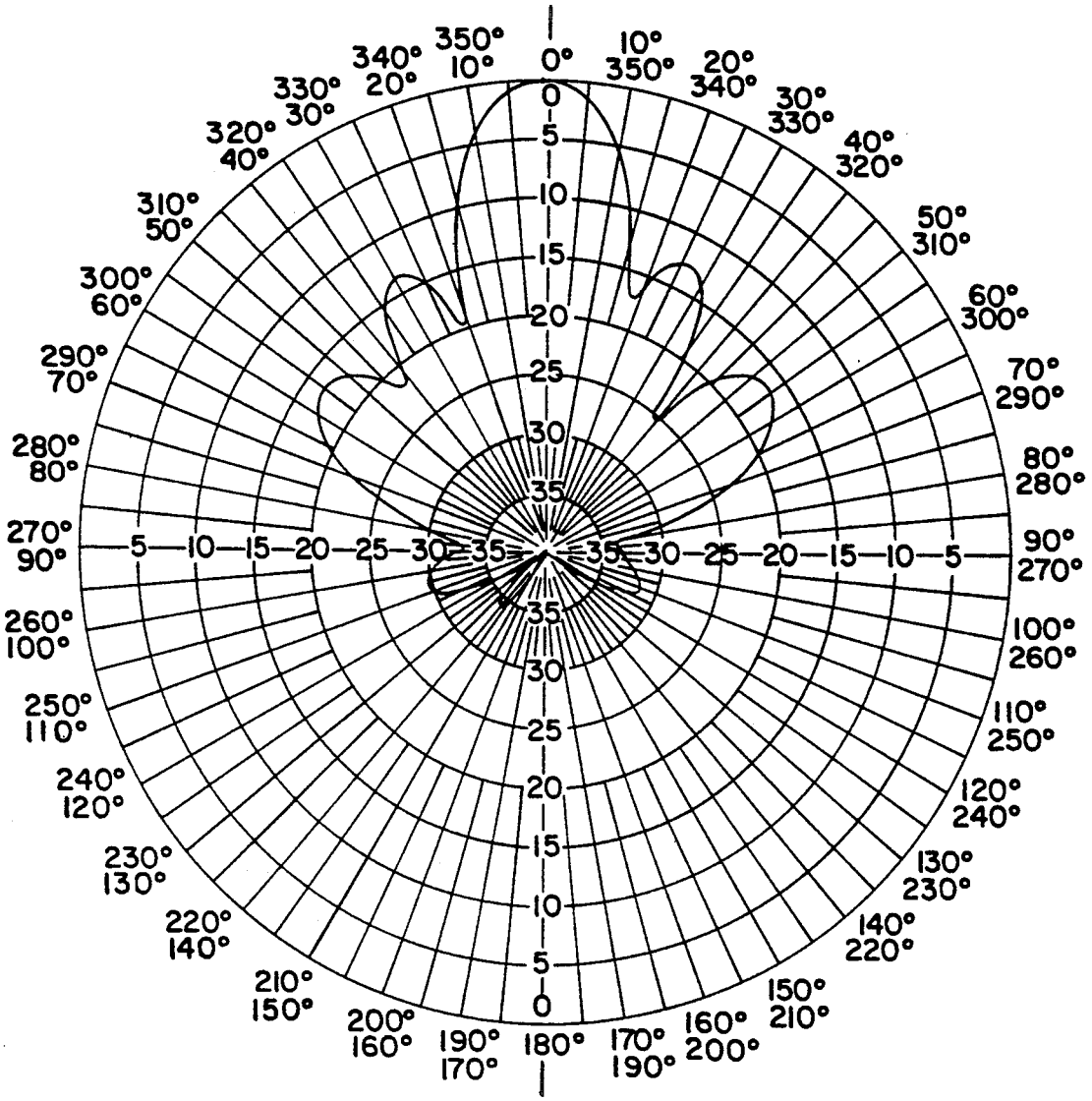
Figure 6D:
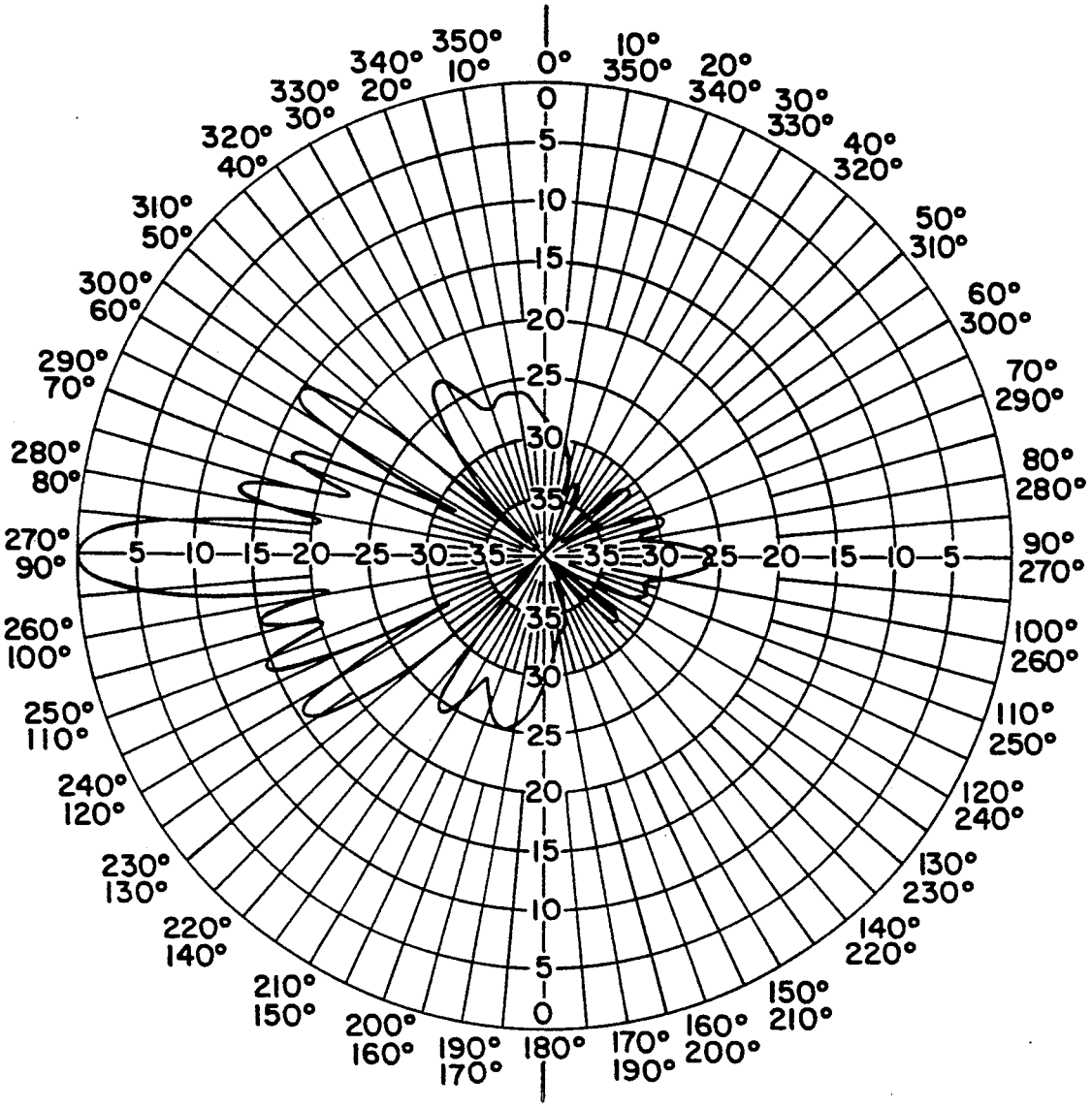

By stacking a plurality of layers of dipole pairs in the vertical direction, the vertical beam is compressed, thereby increasing the antenna gain, as illustrated in FIGS. 6A to 6D, which show E-Plane patterns. FIG. 6A shows the E-Plane pattern for an antenna having a single pair of spaced dipoles. FIG. 6B shows the E-Plane pattern for a two-layer antenna with two pairs of spaced dipoles. In like manner, FIG. 6C is for four pairs and FIG. 6D for eight pairs of dipoles.

While the use of horizontally-spaced dipoles mounted in a reflector box provides for a significantly-improved front-to-back ratio (suppression of backwards radiation), it is essential that a proper feed network be utilized to achieve a satisfactory VSWR and broadband antenna operation. The present invention utilizes a unique air dielectric microstrip binary-feed network which provides the required impedance matching over the specified frequency band, does not interfere with the desired antenna radiation pattern, and has low energy loss.

The dipole array is fed electromagnetically by a microstrip binary-feed network which distributes energy received at an N-type connector 40 from a coaxial feed line. The N connector is of standard design, with the exception that the inner conductor is extended in length to be connected to the conductor bar of the microstrip binary-feed network. The binary-feed network exhibits a negligible loss due to the use of air dielectric and a large conductor in the form of a ¼-inch square aluminum bar material. The N connector 40 is mounted to the bottom 34 of reflector box 32, so that the outer conductor of the coax cable is connected to the bottom 34 and is in electrical contact therewith.

The center conductor of the N connector 40 contacts a first branch member 42 of the microstrip binary-feed network. Member 42 extends vertically in two directions from the N connector 40 and is mounted at each end to the reflector box bottom 34, using a shorting block 44 at each end. The shorting block 44 functions to space member 42 from the ground plane formed by bottom 34 and to short the ends of member 42 to the ground plane. The point of connection of the N connector 40 to the member 42 is offset by a distance equal to ¼λ from the physical center of member 42, so that each end of member 42 is fed with a signal 180° out of phase with the signal fed to the other end. It should be noted that the four dipoles located in the lower half of the antenna are oriented to be 180° out of phase with the four dipoles in the upper half of the antenna. This is evidenced by the fact that cylindrical post 24, which creates the ¼λ short, is positioned on one side of the dipole center on the four dipoles in the lower half of the antenna, but on the other side of the dipole center in the upper half of the antenna. The combination of the ¼λ offset of the feed connection and the dipoles being oriented 180° out of phase causes all of the dipoles to radiate in phase and to provide an improved E-Plane radiation pattern with no beam tilt change over the specified bandwidth.

The microstrip binary-feed network includes two I sections 46, each I section functioning to feed four dipoles. The I sections include vertical conductors 48, each having a length of approximately 0.72λ. The centers of conductors 48 are connected to the member 42 by members 50. The ends of vertical conductors 48 are connected to horizontal conductors 52, the ends of which are connected to the center cylindrical post 20 of each dipole feed arrangement. The signal received by N connector 40 is distributed over the microstrip binary-feed network in two directions from the connector and arrives at each dipole of the upper two pairs precisely in phase, while the signal arrives at the four dipoles of the lower two pairs exactly in phase, but 180° out of phase with the signal arriving at the dipoles of the upper two pairs. Thus, the use of a binary-feed network optimizes pattern bandwidth, since the phase of the signal received at each dipole remains the same despite frequency or wavelength changes.

It should be noted that the vertical conductor of each I section is mounted in front of member 50 and is therefore a different distance from the ground plane formed by the bottom 34 of the reflector box. Since the impedance of the conductors used in the binary-feed network is a function both of conductor size and the distance from the ground plane, the impedance of member 42 differs from that of the conductors of each I section. In the described embodiment, the conductors of each I section, namely 48 and 52, are spaced 0.406 inch from the ground plane and exhibit a line impedance of 119 ohms, while members 42 and 50 are spaced 0.156 inch from the ground plane and exhibit a line impedance of 81 ohms. The effective output impedance of the I sections at the intersection of members 50 and conductors 48, is approximately 65 ohms, as compared to the dipole impedance of 70 ohms exhibited at the bottom of the balun feed.

Member 42 has mounted thereon two capacitive trim tabs 54 which are used to tune the feed network for impedance matching purposes. Additionally, the end sections of member 42 between the connection of member 50 and the short 44 is designed to be approximately ¼λ and functions as a stub which has a minor effect on the feed network impedance. Thus, the I sections 46 function to broadband the impedance locus of the individual dipoles and outputs a closely grouped impedance locus of approximately 65 ohms. Members 42 and 50 join each I section to the feed port at connector 40 to output a matched impedance over the required frequency band of 806–960 MHz and exhibits a 1.5:1 or lower VSWR.

Thus, the present invention provides a broadband directional antenna that exhibits an improved front-to-back ratio (excellent back lobe suppression). The beamwidth of the frontal lobe is uniquely adjusted by controlling the spacing between the adjacent horizontally spaced dipoles and by adjusting the width and depth of the reflector box. The bandwidth of the antenna is uniquely optimized through the use of balun-fed broadband dipole radiators and an air dielectric microstrip binary-feed network. Through the use of an air dielectric microstrip binary-feed network, the network impedance may be easily adjusted to match that of the dipole antennas, thereby achieving maximum efficiency and a low VSWR with minimal losses.

The antenna construction provides an integrated design using standard off-the-shelf components that are easily assembled, resulting in minimal component and labor costs. The reflector box uniquely functions as a reflector, ground plane and a part of a protective housing.

By stacking pairs of horizontally-spaced dipoles in the vertical direction, the vertical radiation pattern may be compressed to increase antenna gain as may be required for a particular installation.

Thus, the present invention provides a broadband directional antenna having greatly improved bandwidth, improved front-to-back radiation ratios, low loss feed system while being constructed of standard components and requiring minimal assembly time.

What is claimed is:

1. A broadband directional antenna, comprising an open reflector box formed of conductive material and having a bottom and four side walls defining an opening, said reflector box having a width and a depth;

an input port for receiving a signal;

a pair of spaced dipoles mounted in said reflector box and separated by a space;

a broadband feed network disposed within said reflector box for connecting the input port to the dipoles, having a microstrip transmission line spaced from the bottom of the box forming an air-spaced dielectric for optimizing impedance over a broad transmission bandwidth and minimizing antenna signal loss;

wherein the microstrip transmission line has a ground plane and a center conductor, wherein the bottom of the reflector box functions as the ground plane, with the center conductor comprising conductive rods mounted parallel to the bottom of the reflector box and spaced therefrom, to provide an air dielectric low loss microstrip.

2. A broadband directional antenna as described in claim 1, wherein the dipoles are oriented vertically to provide a vertically-polarized antenna, said antenna additionally comprising at least one additional pair of spaced dipoles mounted vertically, said additional at least one pair of dipoles being mounted colinearly with the pair of spaced dipoles and being fed by the feed network, whereby vertical radiation is compressed to increase the gain of the antenna.

3. A broadband directional antenna, as described in claim 1, wherein the feed network is a binary-feed network, so that each dipole receives the signal to be radiated at essentailly the same phase, thereby increasing the antenna bandwidth.

4. A broadband directional antenna, as described in claim 3, wherein each dipole is individually fed by the binary-feed network.

5. A broadband directional antenna, as described in claim 4, wherein each dipole is fed by a balun feed.

6. A broadband directional antenna, as described in claim 5, wherein the feed network to the dipoles is impedance matched to the input port of the antenna.

7. A broadband directional antenna, as described in claim 1, wherein the space between the conductors and the bottom of the box determines a network impedance, said network impedance is adjusted to match the dipoles to the input port by adjusting said space.

8. A broadband directional antenna, as described in claim 1, wherein the center conductor of the feed network is formed of a square aluminum rod.

9. A broadband directional antenna, as described in claim 1, wherein the reflector box forms a portion of an antenna housing, said antenna additionally comprising a radome enclosing the box opening, so that the dipoles and feed network are protected from the environment.

10. A broadband directional antenna, as described in claim 1, wherein said reflector box functions as an antenna reflector, a ground plane for an air dielectric microstrip feed, and as a portion of a housing to protect said antenna.

11. A broadband directional antenna as described in claim 1, wherein the pair of spaced dipoles are horizontally spaced.

12. A broadband directional antenna comprising:

an open reflector box formed of conductive material and having a bottom and four side walls defining an opening, said box having a width and a depth;

an input port for receiving a signal;

a first pair of spaced dipoles mounted in said box and separated by a space, and being oriented vertically with respect to the box so as to provide a vertically-polarized antenna;

at least one additional pair of spaced dipoles being mounted vertically with respect to the box and colinearly with said first pair of spaced dipoles;

a low loss broadband feed network disposed within said box for connecting the input port to the dipoles, the feed network comprising:

a ground plane formed by the bottom of the reflector box;

a first linear conductive member having two ends and being electrically connected to the ground plane at each end and spaced therefrom by a first distance;

means for connecting the input port to the feed network, said means having an outer conductor connected to the ground plane and a center conductor connected to the first linear conductive member at a position offset from the center of the member by a distance equal to approximately $\frac{1}{4}\lambda$, where $\lambda$ equals the wavelength of the center frequency of a frequency range of the antenna;

first and second I-shaped conductor sections, each including a center member and two end members perpendicular to the center member, said center member being connected to the end members at the centers thereof, a respective dipole being connected to an end of each end member, said I sections being spaced from the ground plane by a second distance greater than the first distance; and connecting arms connecting the center of the center member of each I section to the first linear conductive member at points approximately $\frac{1}{4}\lambda$ from the ends of the first conductive member, the ends of the first linear conductive member act as stubs for impedance matching, and the first and second distance determine the network impedance and are set so that the network impedance matches the dipole impedance.

13. A broadband directional antenna, as described in claim 12, additionally comprising tuning strips attached to the first linear conductive member at equal distances from the connecting means, said tuning strips providing impedance matching.

14. A broadband directional antenna, comprising:

a conductive reflector panel;

an input port for receiving a signal;

a pair of spaced dipoles mounted in front of said reflector panel;

a balun-type feed for each dipole;

a binary-feed network for connecting the input port to the dipoles via said balun-type feed, said binary-feed network being disposed between the conductive reflector panel and the pair of spaced dipoles and forming an air dielectric microstrip, wherein the reflector panel functions as a ground plane for the microstrip and a center conductor of the binary-feed network comprises conductive rods mounted parallel to the reflector panel and spaced therefrom to provide an air dielectric microstrip.

15. A broadband directional antenna, comprising:

a conductive reflector panel;

an input port for receiving a signal;

a pair of spaced dipoles mounted in front of said reflector panel;

a balun-type feed for each dipole;

a binary-feed network for connecting the input port to the dipoles via said balun-type feed, said binary-feed network being formed of an air dielectric microstrip;

wherein the reflector panel functions as a ground plane for the microstrip and a center conductor of the binary-feed network comprises conductive rods mounted parallel to the reflector panel and spaced therefrom to provide an air dielectric microstrip;

wherein the binary-feed network includes a plurality of segments, the conductive rods of selected segments being spaced at different distances from the reflector panel, so that the line impedance of the microstrip is set to match the dipoles to the input port.

* * * * *